US005732650A

United States Patent [19]

Peterson

[11] Patent Number: 5,732,650

[45] Date of Patent: Mar. 31, 1998

[54] INFLATABLE REINFORCED PLASTIC PONTOON FOR AQUATIC VEHICLES

[75] Inventor: Leroy L. Peterson, Omaha, Nebr.

[73] Assignee: Sportsstuff, Inc., Omaha, Nebr.

[21] Appl. No.: 633,398

[22] Filed: Apr. 16, 1996

[51] Int. Cl.[6] ..... B63B 7/00

[52] U.S. Cl. ..... 114/345; 114/61

[58] Field of Search ..... 114/68, 69, 61, 114/123, 283, 345; 441/66, 65, 40, 41

[56] References Cited

U.S. PATENT DOCUMENTS 2,451,855 10/1948 Mercier et al. ..... 114/345
2,816,299 12/1957 Holladay ..... 441/66
3,930,274 1/1976 Syfritt ..... 114/345

FOREIGN PATENT DOCUMENTS 296460 12/1991 Germany ..... 114/345
2061847 5/1981 United Kingdom ..... 114/345

*Primary Examiner*—Ed L. Swinehart
*Attorney, Agent, or Firm*—Henderson & Strum

[57] ABSTRACT

An inflatable plastic pontoon for aquatic vehicles which utilizes a central longitudinal wall extending between the upper and lower surfaces of the device to produce a somewhat flattened configuration for added stability. The invention also includes a pair of inflatable reinforcement chambers situated centrally along opposing sides of the central wall to provide added strength.

8 Claims, 2 Drawing Sheets

INFLATABLE REINFORCED PLASTIC PONTOON FOR AQUATIC VEHICLES

TECHNICAL FIELD

This invention relates to aquatic devices, and more particularly to pontoons for aquatic vehicles such as pontoon boats and catamarans.

BACKGROUND ART

Pontoons are well known in the aquatic vehicle art and are most commonly fabricated from aluminum to form a hollow, elongate cylinder with closed ends such that it will float. Pontoons fabricated from plastic materials are also known, but these are often less than satisfactory for many applications due to their inherent weakness at the midpoint and tendency to bend.

DISCLOSURE OF THE INVENTION

The present invention discloses an inflatable plastic pontoon for aquatic vehicles which utilizes a central longitudinal wall extending between the upper and lower surfaces of the device to produce a somewhat flattened configuration for added stability. The invention also includes a pair of inflatable reinforcement chambers situated centrally along opposing sides of the central wall to provide added strength.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
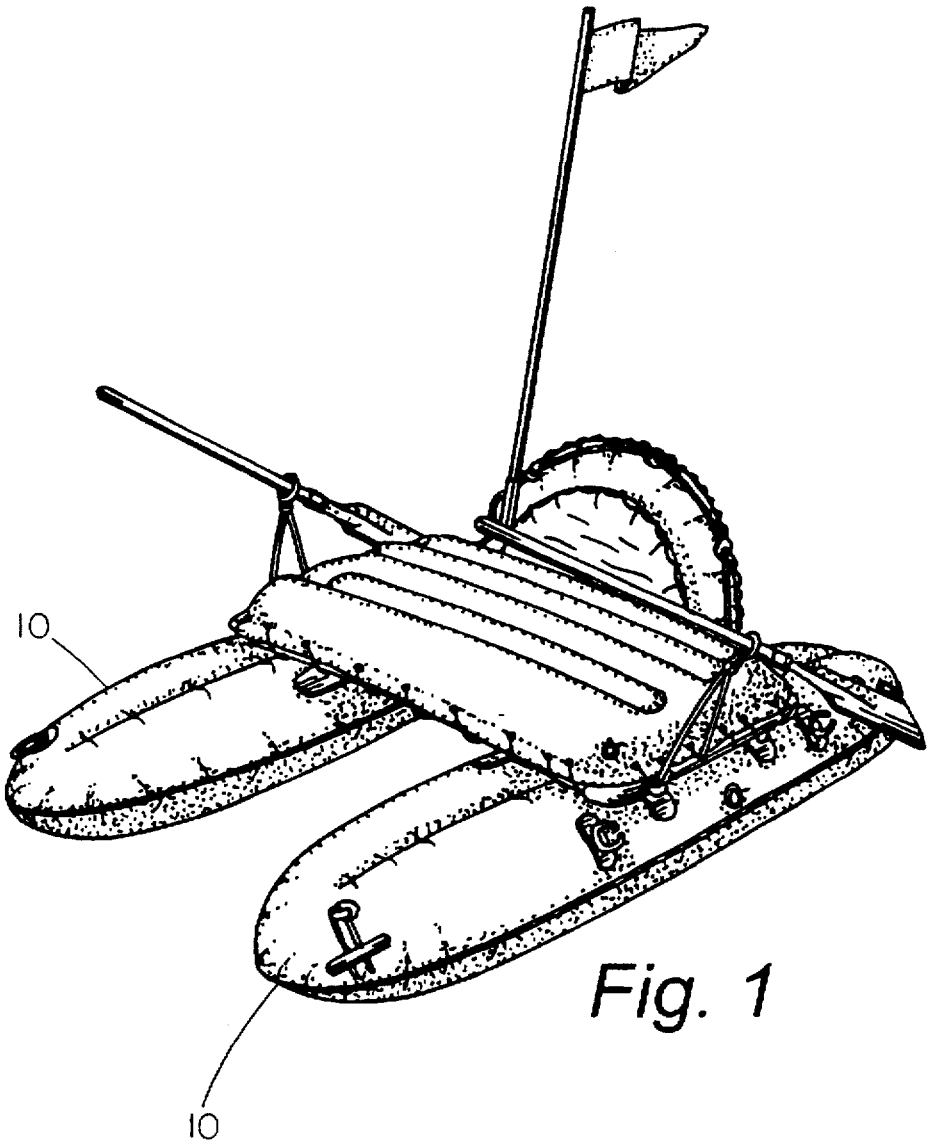
FIG. 1 is a perspective view of a recreational aquatic vehicle utilizing the invention.

Referring now to the drawings, wherein like reference numerals designate identical or corresponding parts throughout the several views, a recreational aquatic vehicle utilizing the present invention at 10 is depicted in FIG. 1.

The pontoon 10 is seen to comprise an upper convex surface 12 and a lower concave surface 14 joined along their respective peripheral edges at 16 to form an inflatable envelope. The pontoon 10 is preferably fabricated from polyvinylchloride, although other plastic materials which are capable of holding air would be suitable as well. With polyvinylchloride, the upper and lower surfaces 12, 14 are preferably sealed together at 16 by thermowelding.

Figure 2:
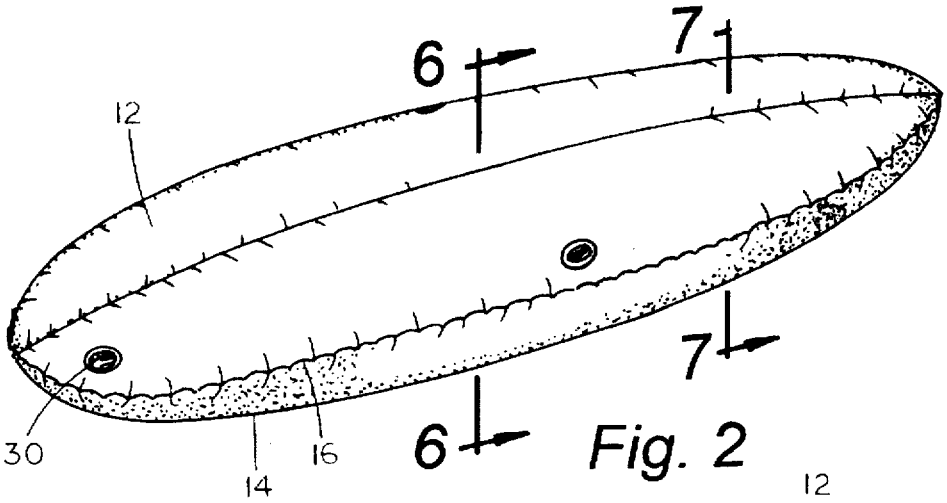
FIG. 2 is a perspective view of the invention itself.
Figure 3:
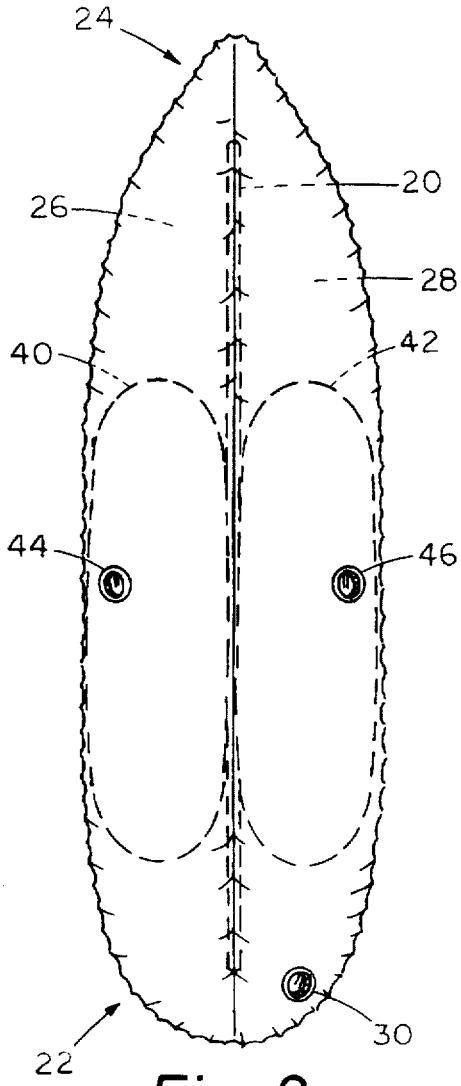
FIG. 3 is a top view of the invention, and depicts the internal components of the invention in phantom lines.
Figure 4:
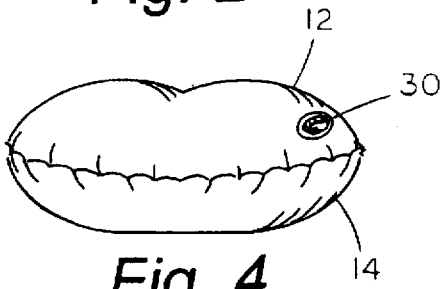
FIG. 4 is a rear end view of the invention.
Figure 5:
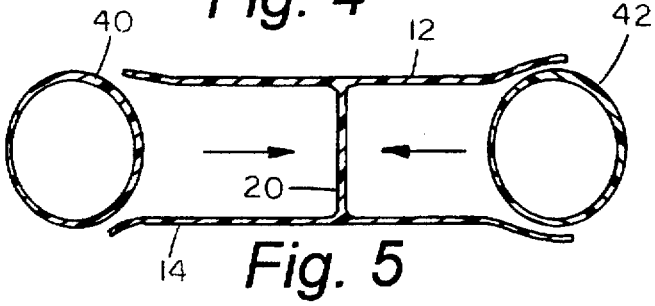
FIG. 5 is an exploded end view of the invention.
Figure 6:
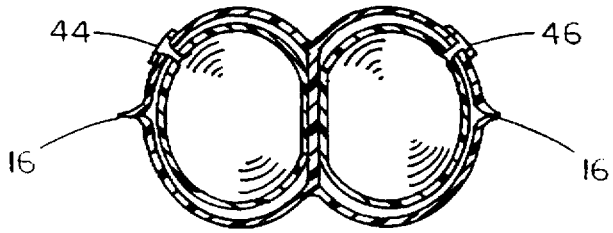
FIG. 6 is a sectional view taken along line 5—5 of FIG. 2.
Figure 7:
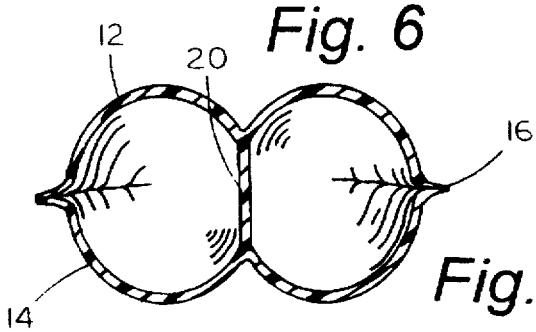
FIG. 7 is a sectional view taken along line 6—6 of FIG. 2.

The upper surface 12 and the lower surface 14 are joined together by a central wall 20 which extends from near the aft end 22 of the invention to near the forward end 24 as seen in phantom lines in FIG. 2. This central wall 20 divides the pontoon into separate compartments 26, 28 and holds the upper and lower surfaces 12, 14 in a somewhat flattened configuration for added stability in the water. Since the compartments 26, 28 are in communication with each other at each end, the pontoon may be inflated by a single inflation port 30.

The invention also comprises a pair of inflatable reinforcement chambers 40, 42 which are situated within the compartments 26, 28 as depicted in phantom lines in FIG. 2. Although enclosed within the compartments 26, 28, the chambers 40, 42 each have a respective inflation port 44, 46 extending to the surface of the pontoon. The reinforcement chambers 40, 42 provide a great deal of added strength to the central, load carrying portion of the pontoon 10.

Obviously, many modifications and variations of the present invention are possible in light of the above teachings. It is therefore to be understood that, within the scope of the appended claims, the invention may be practiced otherwise than as specifically described.

What is claimed is:

1. An inflatable, reinforced pontoon for aquatic vehicles, comprising:

an elongate, convex upper section of pliable material having a front end and a rear end and a peripheral edge;

an elongate, convex lower section of pliable material having a front end and a rear end and a peripheral edge, said upper and lower sections affixed to each other along their peripheral edges, thereby forming an elongate, inflatable envelope;

a central wall of pliable material affixed to, and extending between, said upper section and said lower section; and first and second independently inflatable tubular reinforcement chambers situated within said elongate envelope on opposing sides of said central wall.

2. The pontoon as recited in claim 1, and further comprising an inflation port for each of said first and second reinforcement chambers in communication with an exterior surface of said upper section.

3. An inflatable, reinforced pontoon for aquatic vehicles, comprising:

an elongate envelope of pliable material having an upper section and a lower section, a front end and a rear end;

a central wall of pliable material extending between said upper and lower sections; and first and second independently inflatable tubular reinforcement chambers situated within said envelope on opposing sides of said central wall.

4. The pontoon as recited in claim 3 wherein said first and second inflatable reinforcement chambers are in communication with an exterior surface of said envelope.

5. An inflatable, reinforced pontoon for aquatic vehicles, comprising:

an elongated, contoured outer inflatable envelope having a generally rounded aft end and a generally tapered forward end, a pair of independently inflatable reinforcement chambers disposed in a side by side relationship within, and proximate the midpoint of, the outer envelope wherein the ends of the reinforcement chambers are spaced from the corresponding ends of the outer envelope.

6. The pontoon as recited in claim 5 wherein the outer inflatable envelope is provided with an elongated divider wall disposed intermediate the reinforcement chambers, wherein the elongated outer wall extends beyond both ends of the reinforcement chambers and the opposite sides of the inflatable envelope are in open fluid communication with one another.

7. The pontoon as recited in claim 6 wherein at least one end of the divider wall is spaced from an adjacent end of the inflatable envelope.

8. The pontoon as recited in claim 6 wherein both ends of the divider wall are spaced from the adjacent ends of the inflatable envelope.

* * * * *